US009340016B2

(12) United States Patent
Kritchman et al.

(10) Patent No.: US 9,340,016 B2
(45) Date of Patent: May 17, 2016

(54) METHOD AND DEVICE FOR PRINTING ON HEATED SUBSTRATES

(75) Inventors: Eliahu M. Kritchman, Tel Aviv (IL); Hanan Gothait, Rehovot (IL); Yigal Rozval, Rehovot (IL); Meir Debi, Ramat Gan (IL)

(73) Assignee: XJET LTD, Rehovot (IL)

( * ) Notice: Subject to any disclaimer, the term of this patent is extended or adjusted under 35 U.S.C. 154(b) by 657 days.

(21) Appl. No.: 13/320,765

(22) PCT Filed: May 17, 2010

(86) PCT No.: PCT/IL2010/000398

§ 371 (c)(1),
(2), (4) Date: Dec. 22, 2011

(87) PCT Pub. No.: WO2010/134072

PCT Pub. Date: Nov. 25, 2010

(65) Prior Publication Data

US 2012/0081455 A1 Apr. 5, 2012

Related U.S. Application Data

(60) Provisional application No. 61/179,036, filed on May 18, 2009.

(51) Int. Cl.

| | |
|---|---|
| ***B41J 2/015*** | (2006.01) |
| ***B05C 11/10*** | (2006.01) |
| ***B41J 2/14*** | (2006.01) |
| ***B41J 29/377*** | (2006.01) |

(52) U.S. Cl.

CPC . *B41J 2/14* (2013.01); *B05C 11/10* (2013.01); *B41J 29/377* (2013.01); *B41J 2202/08* (2013.01)

(58) Field of Classification Search

None

See application file for complete search history.

(56) References Cited

U.S. PATENT DOCUMENTS

| | | | |
|---|---|---|---|
| 3,451,791 | A | 6/1969 | Meadoes |
| 4,847,636 | A | 7/1989 | Durbeck et al. |
| 5,136,515 | A | 8/1992 | Helinski |
| 6,291,123 | B1 | 9/2001 | Ohno et al. |
| 6,305,769 | B1 | 10/2001 | Thayer et al. |
| 6,328,418 | B1 | 12/2001 | Yamada et al. |

(Continued)

FOREIGN PATENT DOCUMENTS

| | | |
|---|---|---|
| DE | 4324647 | 1/1994 |
| JP | H09-193404 | 7/1997 |

(Continued)

OTHER PUBLICATIONS

International Search Report mailed on Feb. 17, 2015 in International Application No. PCT/IB2014/065400 (6 pages).

(Continued)

*Primary Examiner* — Dah-Wei D Yuan
*Assistant Examiner* — Jethro M Pence
(74) *Attorney, Agent, or Firm* — Finnegan, Henderson, Farabow, Garrett & Dunner, L.L.P.

(57) ABSTRACT

A printing device for dispending material on a heated substrate is provided. The device may include a printing head having one or more nozzles and a heat shield that partially masks a side of the printing head that faces the heated substrate when printing so as to reduce heat transfer from the substrate to the printing head. The shield includes a slot aligned with the one or more nozzles to enable passage of material from the one or more nozzles to the heated substrate.

14 Claims, 2 Drawing Sheets

(56) References Cited

U.S. PATENT DOCUMENTS

| | | | | |
|---|---|---|---|---|
| 6,514,343 | B1 * | 2/2003 | Motoda | 118/323 |
| 6,536,853 | B2 | 3/2003 | Beauchamp et al. | |
| 7,502,023 | B2 | 3/2009 | Zinniel et al. | |
| 7,506,960 | B2 | 3/2009 | Chikanawa et al. | |
| 7,919,538 | B2 | 4/2011 | Vo et al. | |
| 9,004,667 | B2 | 4/2015 | Taguchi | |
| 2002/0015855 | A1 * | 2/2002 | Sajoto et al. | 428/639 |
| 2004/0115339 | A1 * | 6/2004 | Ito | 427/66 |
| 2004/0246294 | A1 | 12/2004 | Mitsuzawa | |
| 2005/0104241 | A1 | 5/2005 | Kritchman et al. | |
| 2005/0253879 | A1 | 11/2005 | Yamanobe | |
| 2006/0132571 | A1 | 6/2006 | Baker | |
| 2007/0063366 | A1 | 3/2007 | Cunningham et al. | |
| 2007/0211105 | A1 | 9/2007 | Furukawa | |
| 2008/0024557 | A1 * | 1/2008 | Moynihan | 347/56 |
| 2009/0244153 | A1 | 10/2009 | Miyamoto | |
| 2009/0321123 | A1 | 12/2009 | Lochtman | |
| 2010/0040767 | A1 | 2/2010 | Uibel et al. | |
| 2011/0151665 | A1 | 6/2011 | Gothati et al. | |
| 2012/0308837 | A1 | 12/2012 | Schlechtriemen et al. | |

FOREIGN PATENT DOCUMENTS

| | | | | |
|---|---|---|---|---|
| JP | H11-342598 | | 12/1999 | |
| JP | 2003-133692 | | 5/2003 | |
| JP | 2007-152161 | | 6/2006 | |
| JP | 2007-061784 | * | 3/2007 | B05C 5/00 |
| WO | WO 2007/076424 | | 7/2007 | |
| WO | WO 2009/017648 | | 2/2009 | |
| WO | WO 2009/029939 | | 3/2009 | |
| WO | WO 2009/141448 | | 11/2009 | |
| WO | WO 2014/068579 | | 5/2014 | |

OTHER PUBLICATIONS

International Search Report mailed on Jan. 11, 2015 in International Application No. PCT/IB2014/065401 (6 pages).

International Search Report mailed on Oct. 17, 2014 in International Application No. PCT/IB2014/065402 (7 pages).

Cappi B. et al. "Direct inkjet printing of Si3N4: Characterization of ink, green bodies and microstructure," 2008, Journal of the European Ceramic Society, vol. 28 pp. 2625-2628 (published online: Apr. 28, 2008).

Mott M. et al. "Microengineering of Ceramics by Direct Ink-Jet Printing," 1999, J. Am. Ceram. Soc., vol. 82 ,No. 7, pp. 1653-1658 (Jul. 31, 1999) DOI: 10.1111/j.1151-2916.1999.tb0.

Ozkol E. et al. "Development of high solid content aqueous 3Y-TZP suspensions for direct inkjet printing using a thermal inkjet printer," 2009, Journal of the European Ceramic Society, vol. 29, pp. 403-409 (published on line: Aug. 13, 2008).

Song H. J. et al. "Formulation and Multilayer jet Printing of Ceramic Inks," 1999, J. Am. Ceram. Soc., vol. 82 ,No. 12, pp. 3374-3380 (Dec. 31, 1999).

* cited by examiner

METHOD AND DEVICE FOR PRINTING ON HEATED SUBSTRATES

CROSS-REFERENCE TO RELATED APPLICATIONS

This application is a National Phase Application of PCT International Application No. PCT/IL2010/000398, International Filing Date May 17, 2010, claiming priority of U.S. Provisional Patent Application 61/179,036, filed May 18, 2009

BACKGROUND

Non-contact deposition printing systems, such as inkjet printing systems, are being increasingly utilized in the manufacture of printable electronics. For example, such systems may be used to metallize layers by depositing an electrically conductive material (ink) on various substrates for applications such as radio-frequency identification (RFID), organic light-emitting diodes (OLED), photovoltaic (PV) solar cells, and other printable electronics products.

In some applications, for example, metallization of silicon wafers during production of solar cells, it is desirable to deposit the material on a hot substrate surface. The hot substrate may undesirably heat the nozzle plate and may adversely affect the quality of the printing. Additionally, fumes evaporating from the liquid material dispensed onto the heated substrate may also adversely affect the operation of the printing head as the fumes may condense onto the nozzle plate in the form of droplets.

BRIEF DESCRIPTION OF THE DRAWINGS

The subject matter regarded as the invention is particularly pointed out and distinctly claimed in the concluding portion of the specification. The invention, however, both as to organization and method of operation, together with objects, features and advantages thereof, may best be understood by reference to the following detailed description when read with the accompanied drawings in which:

Figure 1:
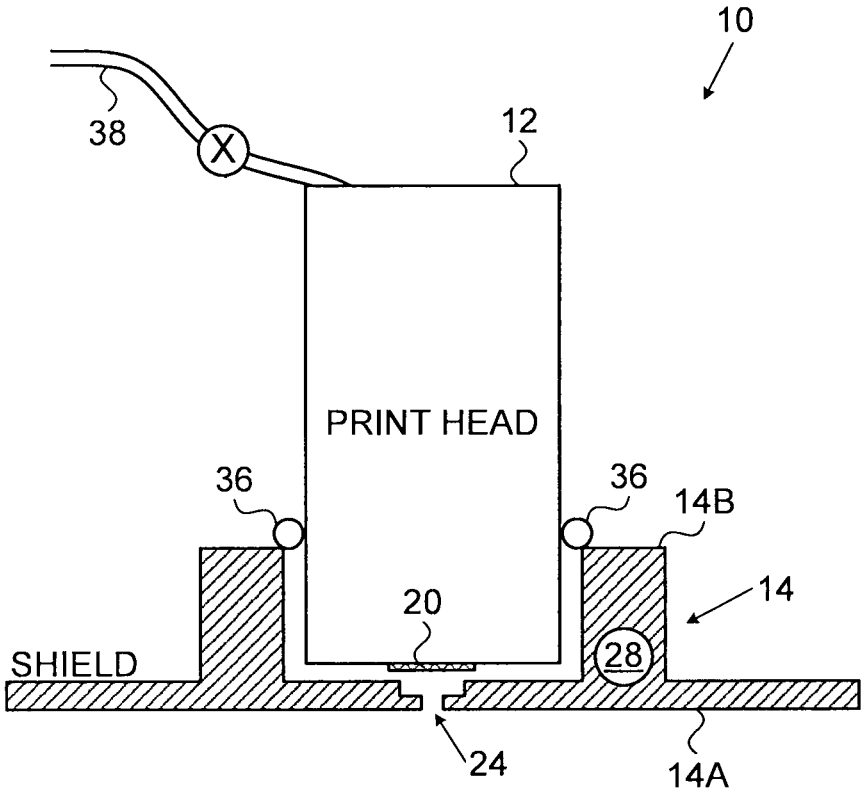
FIG. 1 is a schematic cross sectional illustration of an exemplary printing head and a shield according to embodiments of the present invention.

It will be appreciated that for simplicity and clarity of illustration, elements shown in the drawings have not necessarily been drawn accurately or to scale. For example, the dimensions of some of the elements may be exaggerated relative to other elements for clarity. Further, where considered appropriate, reference numerals may be repeated among the drawings to indicate corresponding or analogous elements. Moreover, some of the blocks depicted in the drawings may be combined into a single function.

DETAILED DESCRIPTION OF EMBODIMENTS

In the following detailed description, numerous specific details are set forth in order to provide a thorough understanding of the invention. However, it will be understood by those of ordinary skill in the art that the invention may be practiced without these specific details. In other instances, well-known methods, procedures, components, modules, units and/or circuits have not been described in detail so as not to obscure the invention.

Embodiments of the invention are directed to a method and a printing device, such as inkjet printing systems or aerosol jetting systems utilizing a focused aerosol stream of particles, for non-contact deposition of material on a heated substrate. According to some embodiments, a shield or a cooled mask may be coupled to the printing head of the system so as provide a shield between the heated substrate and the printing head. The terms "material", "printing fluid" and "ink" may be used interchangeably throughout the Specification and claims.

A printing device according to embodiments of the present invention may be operated so as print on a heated substrate while shielding the printing head. For example, the printing head may be operated so as to deposit ink on the heated substrate via a slot in a heat shield plate of the device. Water or another coolant may be circulated through the shield frame so as to remove heat from the shield frame and plate. Thus, the shield plate may prevent the overheating of the printing head. Further, the shield may inhibit fumes that evaporate from the heated substrate from condensing on a nozzle plate of the printing head.

In addition, suction or pressure may be applied to an air duct so as to induce air flow between the shield plate and the printing head, or between the shield head and the substrate. The air flow in between the shield and the printing head may exit through the slot and may push away hot air from the substrate that would otherwise enter through the slot in the direction of the printing head.

For example, the printing device may be used to apply metallization to silicon wafers during the production of solar cells. The metallization may provide electrical contact to the cell for electrically connecting the cell to one or more devices. Accordingly, the material may be an electrically conductive material (electrically conductive ink and the substrate may be a semiconductor wafer. During the deposition process, the semiconductor wafer may be heated in order to expedite the printing process, for example, to a temperature of 100° C. to 300° C. According to some embodiments, the nozzles may be arranged in a single row on a nozzle plate of the printing head, so as to print a single metallization line on the substrate. It should be understood, however, that embodiments of the invention are not limited to this application and any other non-contact deposition application falls within the scope of the invention.

Reference is now made to FIG. 1, which is a schematic illustration, in a cross section view, of a printing device according to embodiments of the invention. A printing device 10, which may be part of an inkjet printing system, may include a printing head 12 and a heat shield 14. Printing head 12 may be coupled to an ink supply tube 38 that may provide printing head 12 with material (ink) for ejection through the nozzles of nozzle plate 20.

Figure 2:
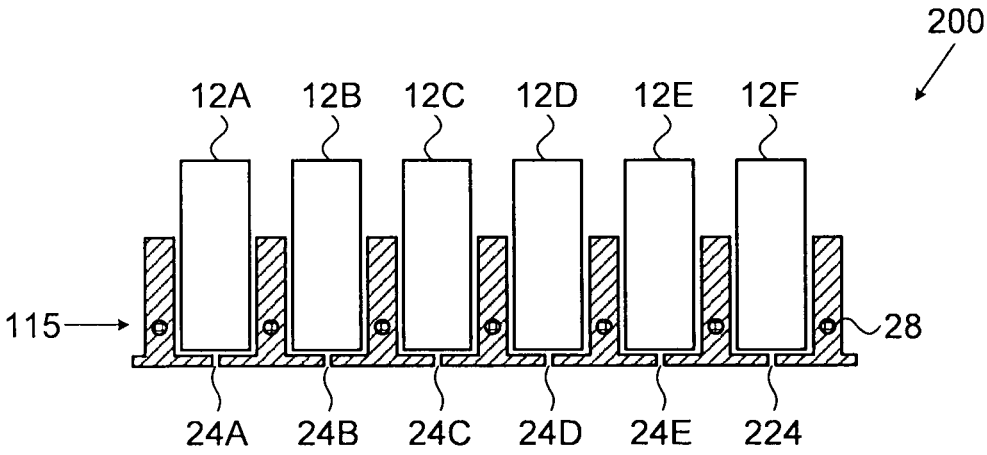
FIG. 2 is a schematic illustration of an exemplary printing unit having multiple printing heads and a shielding structure according to embodiments of the present invention.

Printing head 12 may include one or more rows of nozzles through which a printing fluid is ejected (not shown). Optionally, printing head 12 may include a nozzle plate 20 with one or more rows of nozzles on an outward-facing side of the printing head. In some embodiments of the present invention, a printing head may be provided with multiple nozzle plates. Alternatively, multiple printing heads may be arranged in fixed positions relative to one another, as illustrated at FIG. 2. Such arrangements may be used, for example, to print several lines concurrently.

Heat shield 14 may include a shield plate 14A having a shield slot 24 positioned opposite the row of nozzles and a shield frame 14B. Printing head 12 may be provided with more than one row of nozzles and the slot may then be wider and aligned with all rows. Alternatively, shield plate 14 may include more than one slot 24, where each slot is aligned with a respective row of nozzles and each slot enables its corresponding row of nozzles to deposit ink on a substrate. It should be understood to a person skilled in the art that a row of nozzles may include any number of nozzles including a single nozzle.

Figure 3:
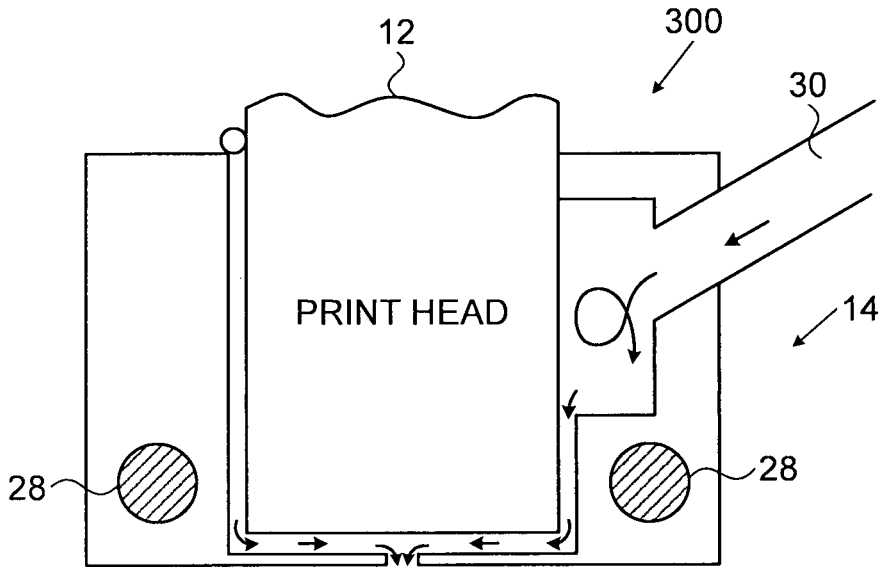
FIG. 3 is a schematic illustration of an exemplary printing head and a shield according to other embodiments of the present invention.

Shield frame 14B may hold shield plate 14A at a fixed position relative to printing head 12. According to some embodiments, shield plate 14A and shield frame 14B may be machined from a single piece of metal. Shield 14 may include one or more coolant duct 28 through which a coolant may flow and circulate. Shield 14 may at least partially surround printing head 12 forming a gap or space between the printing head 12 and shield frame 14B. The space may facilitate air flow as shown in FIG. 3 and may also enable accurate adjustment of printing head 12 in shield 14. The gap may be sealed by a seal 36. For example, seal 36 may include a sealing gasket or one or more strips of sealing material. The sealing material may include sealing foam, rubber, silicone, caulking material, or any other suitable sealing material known in the art.

During the deposition process, a heated substrate (not shown) may be positioned opposite the nozzles, at an appropriate distance. The substrate may be mounted on a heating plate (not shown). According to embodiments of the invention, shield 14 may prevent heat from the heated substrate from overheating printing head 12. Shield plate 14A may serve as a mask that at least partially covers or masks the outward-facing side of the printing head while enabling to deposit ink on the substrate through the slots.

The thickness of shield plate 14A may be limited by the distance between the nozzles and the substrate. For example, to enable printing at a required quality, the nozzle may be placed within a relatively small distance from the substrate surface. The thickness of the shield plate should then be small enough so as not to increase the distance between the nozzle and the substrate surface. For example, if the desired distance between the nozzles and the substrate surface may be about 1 mm, the thickness of the shield plate may be limited, for example, to 0.2-0.5 mm. According to embodiments of the invention, shield plate 14A may be thick enough to enable both construction strength and the desired heat conductance from the shield plate ro the cooled shield frame.

Slot 24 in shield plate 14A may be made narrow so as to maximize shielding of the printing head from heat, typically convective heat due to air heated by the substrate. In addition, a narrow slit may shield the printing head from fumes evaporated from the heated substrate and capable of condensing on the printing head. For example, the width of the slot may be less than 0.5 mm. According to some embodiments, for proper shielding, the slot width may be a fraction of the thickness of the shield plate. For example, the slot width may be less than one half the thickness of the shield plate. For example, a narrow slot may inhibit free flow of undesirable gasses through the slot. On the other hand, other considerations may limit the width of the slot to a width wider than a minimum value. For example, the minimum width of the slot may be determined in accordance with a requirement that the slot not interfere with deposition of ink by the printing head onto the substrate. For example, the width of the slot may be made 3 to 20 times greater than the nozzle diameter. For example, a slot width may be about 0.1 mm to 0.2 mm.

Shield 14 may be constructed so as to include a material that is heat conducting. For example, a suitable material may include a metal such as aluminum or copper, or any other suitable heat conducting plastic or ceramic. Shield plate 14A may be connected to shield frame 14B in such a manner as to provide good thermal contact between the shield plate and the shield frame. For example, the shield frame and the shield plate may be machined from a single piece of metal. Alternatively, the shield plate may be bolted, welded, soldered, glued, or otherwise affixed to the shield frame using appropriate heat conducting connecting materials. Shield frame 14B may provide mechanical support for shield plate 14A. In addition, the shield frame may provide thermal mass so as to form a heat sink for heat conducted away from the shield plate. For example, the walls of the shield frame may be made sufficiently thick so as to provide a suitable thermal mass, as well as sufficient mechanical strength. Providing thick walls may also facilitate good thermal conductance from the joint with the shield plate to the location of the cooling conduct engraved or connected to the shield frame.

Coolant duct or ducts 28 through which a coolant may flow and circulate may be positioned within shield 14 in any possible construction, for example, the ducts may surround the walls of printing head 12. The duct may be engraved in shield frame 14B. According to some embodiments, the shield frame may include one or more bores through which a coolant fluid may flow or circulate. For example, water may serve as an appropriate coolant fluid. The circulating coolant may convey heat away from shield frame 14B and the attached shield plate 14A to a reservoir, or to a heat exchange device where heat is removed from the coolant.

One or more surfaces of shield plate 14A may be coated or constructed of a low emissivity material that may inhibit radiative heating of the printing head by the heated substrate. For example, an outward facing surface of the shield plate 14A, that is, a surface of the shield plate that faces away from the printing head and toward the heated substrate, may reflect thermal radiation emitted by the substrate. For example, if the substrate is heated to a temperature of 200° C. to 300° C., the outward facing surface of shield plate 14A may be designed to reflect thermal infrared radiation. For example, the surface or shield plate may be constructed of polished bare aluminum. In addition, an inward facing surface of the shield plate may be designed to have a low emissivity so as to prevent radiative heating of printing head 12 by the shield plate 14A.

Shield 14 may be designed to inhibit or prevent trapping or buildup of ink drops or particles. For example, in the absence of such a design, fumes containing ink components that evaporate from a heated substrate may condense on the shield plate 14A, in a slot of the shield plate 24, on a nozzle plate 20 of printing head 12, or in the gap between the shield plate 14A and the nozzle plate 20. Similarly, stray ink, such as a mist, spray, or droplets emitted by a nozzle of printing head 12 may be collected on the shield plate, in a slot of the shield plate, on a nozzle plate of the printing head, or in the gap between the shield plate and the nozzle plate.

Shield plate 14A may include one or more non-wetting surfaces in order to inhibit collection of ink on those surfaces. A non-wetting surface may inhibit the adhesion of a liquid such as ink to the surface. For example, one or more surfaces of the shield plate 14A may be coated with Teflon. For example, an inward-facing surface of shield plate may be a non-wetting surface. The inward-facing non-wetting surface of the shield plate 14A may inhibit the buildup of fluid between the shield plate and the printing head. (A non-wetting surface on an outward-facing surface of nozzle plate 20 of the printing head may similarly inhibit fluid buildup between the nozzle plate and the shield plate.) Similarly, the walls of a slot in the shield plate may optionally be made non-wetting surfaces. For example, non-wetting slot walls may inhibit fluid buildup within the slot. An outward-facing surface of shield plate 14A may optionally be a non-wetting surface. Alternatively, an inward-facing surface of the shield plate 14A (and possibly the slot walls) may be non-wetting, while an outward-facing surface of the shield plate is wetting. In this case, fluid may be drawn from the inward-facing surface to the outward-facing surface. This may serve to keep the gap between the shield plate 14A and the printing head 12 clear of fluid. In such a case, it may be necessary to occasionally clean the outward-facing surface of ink or fluid.

Reference is now made to FIG. 2, which is an exemplary illustration of a printing unit having multiple printing heads according to embodiments of the invention. In these embodiments, a single shield 115 may be designed to accommodate multiple printing heads 12A-12F. Shield 115 may include a shield plate having a plurality of slots 24A-24F therein, each positioned opposite a corresponding nozzle or nozzle row of one of printing heads 12A-12F. Even thought the exemplary embodiments includes 6 printing heads, it should be understood to a person skilled in the art that embodiments of the invention are not limited in that respect and other embodiments may be directed to ant number of printing heads. Shield 115 may include one or more coolant ducts 28, independent from or coupled to each other.

Reference is now made to FIG. 3, which is a schematic illustration of an exemplary printing head and a shield connected to a source of pressurized air or gas according to other embodiments of the present invention. In addition to coolant duct(s) 28, a printing device 300, which may be part of an inkjet printing system, may include one or more air ducts 30 for generating air flow within the gap between printing head 12 and shield 14. Such air flow may assist in cooling the printing device. Air flow may also assist in maintaining spaces of the printing device free of fluid buildup. For example, duct 30 may be connected to the gap between the shield frame and the walls of printing head 12. Another end of air duct 30 may be connected to a pressure source or device (not shown), such as a blower to, compressor, or tank of pressurized air or gas. Operation of the pressure source may force air to flow out of slot 24 in the shield plate. The outward air flow may act to prevent hot air and/or fumes from entering through the slot.

According to some embodiments, the air flow induced within the gap may have a sufficiently slow airflow rate so as not to interfere with deposition of ink emitted from the nozzles onto the substrate. Alternatively, the air flow from air duct 30 may be synchronized with printing operations so as not to interfere with ink deposition. For example, the air flow may be induced only when no ink is being emitted from the nozzles. Air duct 30 may connect the gap between printing head 12 and shield 14 to a device for inducing flow of air (or another gas) through the gap.

Instead of inducing air flow into the gap, an air duct 30 may also such air from the gap, causing air to enter the through the slot in the shield when the printing head is not in used and away from the hot substrate. For example, the air at a cool room may flow through slot 24 to help cooling the nozzles at printing head 12.

Figure 4:
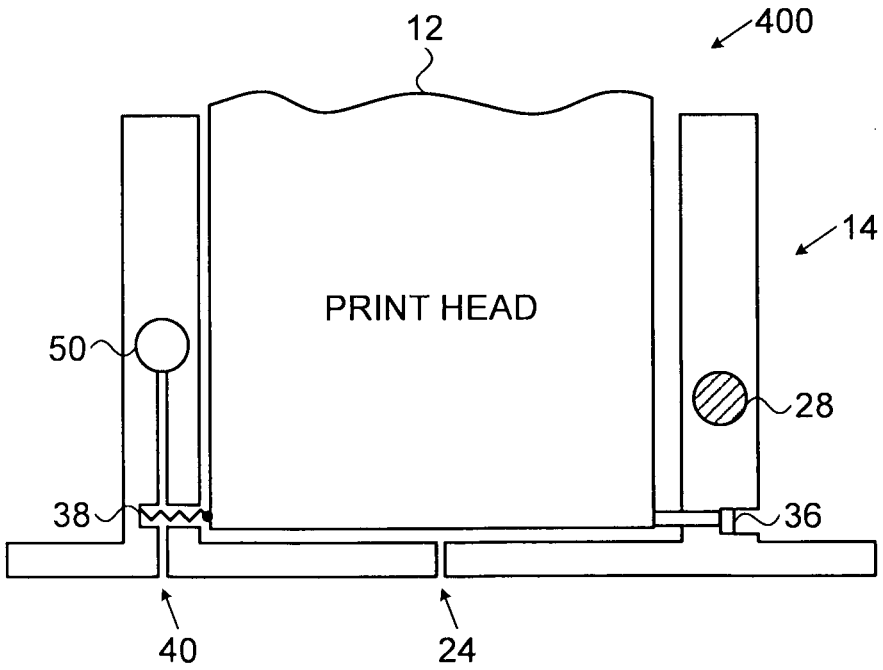
FIG. 4 is a schematic illustration of an exemplary printing head according to alternative embodiments of the present invention.

Reference is now made to FIG. 4, which shows which is a schematic illustration of an exemplary printing head and a shield connected to an air suction unit according to other embodiments of the present invention. Additionally or alternatively to coolant duct(s) 28, a printing device 400, which may be part of an inkjet printing system, may include am air suction unit 50 to collect fumes coming from a heated substrate. Air suction unit 50 may be positioned coupled to an air opening 40 on an outward facing surface of shield plate 14A. For example, if suction is applied to air suction 50, fumes located between shield plate 14A and the heated substrate (not shown) may be drawn toward air opening 40, inducing an air flow away from shield slot 24. The air flow may prevent fluid buildup in or near the nozzles and/or shield slot 24. Multiple air openings may be provided at different locations on the outward-facing surface of shield plate 14A. Multiple air openings may enable a greater airflow rate or a symmetric airflow pattern.

The surface of shield plate 14A facing the nozzles may be coated with a non-wetting coating, or otherwise designed to be non-wetting. The non-wetting coating may inhibit buildup of fluid in the vicinity of the nozzles and shield slot 24.

According to embodiments of the invention a mechanism for ensuring alignment of the nozzles with shield slot 24 may include a screw 36 and a spring 38. Screw 36 and spring 38 apply countering forces to printing head 12, holding printing head 12 at a given position relative to shield frame 14B. Rotation of screw 36 may adjust the distance that screw 36 extends inward from shield frame 14B. Varying the distance that screw 36 extends inward from shield frame 14B may vary the position of printing head 12 relative to shield frame 14B. The position and alignment of printing head 12 relative to shield frame 14B may be adjusted until the nozzle row aligns with shield slot 24 and with other machine requirements, such as for example the direction of the nozzle array relative to the scanning direction.

While certain features of the invention have been illustrated and described herein, many modifications, substitutions, changes, and equivalents may occur to those of ordinary skill in the art. It is, therefore, to be understood that the appended claims are intended to cover all such modifications and changes as fall within the true spirit of the invention.

What is claimed is:

1. A printing device, comprising:

a substrate configured to be heated during a printing process;

at least one print head spaced from the substrate surface and including a plurality of nozzles configured to print a metallic material atop the heated substrate; and a heat shield located between the substrate surface and the at least one print head and configured to prevent heat from the heated substrate from overheating the at least one print head, the heat shield being distinct from the at least one print head and including a plurality of slots, wherein each slot is configured for alignment with at least one nozzle, and the plurality of slots being arranged in the heat shield to enable metal from the at least one nozzle to pass through a corresponding slot for deposition atop the heated substrate.

2. The device of claim 1, wherein the heat shield includes a duct therein for conveying a liquid coolant.

3. The device of claim 1, wherein an outward surface of the heat shield is reflective to thermal infrared radiation.

4. The device of claim 1, wherein the heat shield includes a thermally conducting material.

5. The device of claim 1, wherein the heat shield includes aluminum or copper.

6. The device of claim 1, wherein an inward surface of the heat shield facing the at least one print head is coated with a non-wetting coating.

7. The device of claim 1, further including an air duct configured to induce movement of air between the heat shield and the at least one print head.

8. The device of claim 1, further including:

an air suction unit coupled to an air opening in a side of the heat shield that faces the heated substrate when printing.

9. The device of claim 1, wherein the plurality of nozzles are arranged in a single row of a print head for printing a single metallization line on the heated substrate.

10. The device of claim 1, wherein the heat shield is adjustable to enable the slots to be aligned with the nozzles.

11. The device of claim 1, wherein a width of each slot is less than 0.5 mm.

12. The device of claim 1, wherein a width of each slot is between 3 to 20 times greater than a typical width of each nozzles.

13. The device of claim 1, wherein a thickness of a portion of the heat shield is between 0.2 to 0.5 mm.

14. The device of claim 1, wherein the substrate is configured to be heated to a temperature of about 100-300° C.

* * * * *